US006997318B2

(12) United States Patent
Park

(10) Patent No.: US 6,997,318 B2
(45) Date of Patent: Feb. 14, 2006

(54) PACKING APPARATUS FOR LIQUID CRYSTAL DISPLAY MODULES

(75) Inventor: Sun-Im Park, Kumi-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 269 days.

(21) Appl. No.: 09/778,748

(22) Filed: Feb. 8, 2001

(65) Prior Publication Data

US 2001/0019370 A1 Sep. 6, 2001

(30) Foreign Application Priority Data

Feb. 16, 2000 (KR) ..... 2000-7384

(51) Int. Cl.
*B65D 85/48* (2006.01)

(52) U.S. Cl. ..... 206/454; 211/41.1

(58) Field of Classification Search ..... 206/454, 206/455, 449, 587, 591, 592, 593, 589, 588; 211/41.1, 41.14, 41.18; 118/500; 220/4.16, 220/4.28, 6

See application file for complete search history.

(56) References Cited

U.S. PATENT DOCUMENTS 2,863,595 A * 12/1958 Emery ..... 229/406
2,941,708 A * 6/1960 Crane et al. ..... 229/406
3,016,177 A * 1/1962 Chaplin ..... 229/406
3,990,576 A * 11/1976 Heaney ..... 206/453
4,478,331 A * 10/1984 Ruin ..... 206/707
4,482,074 A * 11/1984 Lalley ..... 220/4.28
4,779,752 A * 10/1988 Vallee et al. ..... 220/533
5,605,246 A * 2/1997 Rausch et al. ..... 220/555
5,806,683 A * 9/1998 Gale ..... 206/587
5,816,415 A * 10/1998 Ahn et al. ..... 211/41.18
5,950,836 A * 9/1999 Iwamoto et al. ..... 206/711
6,142,304 A * 11/2000 Moren et al. ..... 206/587
6,145,663 A * 11/2000 Kim et al. ..... 206/454
6,345,720 B1 * 2/2002 Redden et al. ..... 206/725

* cited by examiner

*Primary Examiner*—Shian T. Luong
(74) *Attorney, Agent, or Firm*—McKenna Long & Aldridge LLP

(57) ABSTRACT

A liquid crystal display module packing apparatus having a rectangular lower plate, first and second side walls that extend from sides of the lower plate, and an upper plate that extends from an upper edge of the first side wall. To provide structural support, a plurality of auxiliary side walls extend from the ends and the middle of the first and second side walls. A plurality of fixing jaws are located on inner surfaces of the packing apparatus. Those fixing jaws receive and retain liquid crystal display modules. A plurality of grooves are located at side edges of the upper plate, and at upper edges of the first and second side walls. The liquid crystal display module packing apparatus can be unfolded into a flat structure.

7 Claims, 2 Drawing Sheets

PACKING APPARATUS FOR LIQUID CRYSTAL DISPLAY MODULES

This application claims the benefit of Korean Patent Application No. 2000-7384, filed on Feb. 16, 2000, which is hereby incorporated by reference as if fully set forth herein.

BACKGROUND OF THE INVENTION

1. Field of the Invention

The present invention relates to an apparatus for packing liquid crystal display modules.

2. Discussion of the Related Art

When packaging new liquid crystal display modules (LCMs) it is very important to protect each liquid crystal display module from damage that may occur during loading, charging, transporting, shipping, and the like.

As shown in FIG. 1, a typical LCM 100 has first and second frames 2 and 4 that surround a liquid crystal panel (not shown) and a back-light device (not shown). The backlight device includes a lamp (not shown) in a lamp housing (also not shown). A lamp wire 6 that is used to connect the lamp to an exterior power source extends from the LCM. Depending on the particular model, the lamp wire 6 may exit the LCM at various positions. The liquid crystal panel (not shown) in the LCM 100 includes a plurality of switching devices and driving circuits for driving the switching devices. Since the switching devices and driving circuits are affected by static electricity and exterior impact, a special packing apparatus for LCMs has been developed to safely pack the LCMs.

FIG. 2 is a perspective view illustrating a conventional packing apparatus 40 for packing typical LCM 100 In FIG. 2, the packing apparatus 40 includes a packing frame 42 having a structure that includes a lower plate 42*c*. The lower plate 42*c* preferably comprises a substantially rectangular frame member with an open space defined at a central area. Side walls 42*b* and 42*d* attach at side edges of the lower plate 42*c*. Each of the side walls 42*b* and 42*c* includes a cover 42*a* that extends from the upper ends of the side walls 42*b* and 42*d*. The covers 42*a* can pivot over the top of the side walls and extend down inside of the packing apparatus. After liquid crystal display modules have been inserted into the packing apparatus 40 the covers 42*a* retain the LCM in the packaging assembly. A plurality of projections 44 are beneficially provided on the outer surface of the packing frame 42. Those projections are for absorbing external impacts applied to the packing apparatus 40.

Fixing jaws 46 are disposed on the inner surface of the side walls 42*b* and 42*d*. The fixing jaws receive and hold individual LCMs 100 The conventional packing apparatus 40 is preferably made from plastic, such as expanded polyethylene (EPE) or expanded polypropylene (EPP), using a metal mold. In operation, the lower plate 42*c*, side walls 42*b* and 42*d*, and upper covers 42*a* protect LCMs 100 from exterior impact.

The packing frame 42 preferably has slant surfaces at its edges or joints so that it can be easily folded. In other words, each of the edge portions or interconnected joints of the packing frame has a longitudinal section in the shape of a "V", and the side walls 42*b* and 42*d* are foldably connected to the lower plate 42*c*. Furthermore, the upper plates 42*a* are foldably connected to the respective side walls 42*b* and 42*c*. Thus, the packing apparatus 40 can easily be transformed from flat to the folded state shown in FIG. 2. Furthermore, the sum of the widths of the two covers 42*a* is beneficially equal to or less than the width of the packing frame 42.

The projections 44 spaced along the outer surfaces of the packing frame 42 serve to relieve and absorb exterior impacts applied to the apparatus 40. The projections 44 are beneficially positioned on each side of the outer surface of the packing frame 42 and have a cross-section in the shape of a letter "U".

The fixing jaws 46 are separated by a predetermined distance along each side wall 42*b* and 42*d*, and are opposed by other fixing jaws 46 on the opposite side wall. If the packing assembly 40 holds ten liquid crystal display modules, the inner surfaces of the side walls 42*b* and 42*d* are provided with eleven pairs of fixing jaws 46. The number of LCMs 100 to be accommodated in the packing assembly 40, and the required number of fixing jaws 46, can be varied as needed.

Each LCM 100 is placed in a shielding bag 10 before being inserted into the packing apparatus 40. The shielding bag protects the LCM from static electricity and from exterior impacts. The shielding bag 10 is made of polypropylene (PP), polyethylene (PE) or the like, and includes metallic material to protect the LCM from static electricity.

The packing apparatus 40 has a disadvantage in that the fixing jaws 46 hold only two sides of each LCM 100. Therefore, if a packing apparatus 40 holding LCMs 100 is dropped, or if the LCMs are stored for a long time, the LCMs 100 tend to become bent.

Furthermore, when the covers 42*a* are closed, they forcefully contact the shielding bag 10 containing the LCM 100 such that pressure is applied to the lamp wire 6. Therefore, if an LCM is stored in the packing apparatus 40 for a long time, a lamp wire 6 may be damaged by pressure applied by the covers 42*a*.

In addition, during packing or unpacking work, because both of the two upper substrates 42*a* must be closed or opened, work efficiency is poor.

SUMMARY OF THE INVENTION

Accordingly, the present invention is directed to a packing apparatus for liquid crystal display modules, which substantially obviates one or more of the problems due to limitations and disadvantages of the related art.

An object of the present invention is to provide a packing apparatus that minimizes bending of LCMs from dropping or storing.

Another object of the present invention is to provide a packing apparatus that reduces damage to a lamp wire of an LCMs.

Another object of the present invention is to provide a packing apparatus that improves the efficiency of packing or unpacking.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings.

An embodiment of the present invention provides a liquid crystal display module packing apparatus. That apparatus includes a rectangular lower plate, first and second side walls that extend from respective sides of the lower plate, and an upper plate that extends from an upper edge of the first side wall to an upper edge of the second side wall. The apparatus further includes a plurality of auxiliary side walls, some extend from the ends of the first and second side walls, and others extend from the middle of the first and second side walls. Additionally, a plurality of fixing jaws are located on inner surfaces of the lower plate, of the first and second side walls, and of the upper plate. Adjacent fixing jaws on the same surface are spaced apart with a gap that corresponds to the thickness of a liquid crystal display module. Opposed fixing jaws act to receive and retain inserted LCMs.

A plurality of projections are provided on outer surfaces of the apparatus to relieve exterior impacts. Each projection preferably has an alternating stepped shape.

A plurality of grooves are beneficially disposed at side edges of the upper plate. The grooves receive the lamp wires of the liquid crystal display module. Additional grooves can be disposed at the upper edges of the first and second side walls. Again, the grooves are to receive the lamp wires.

The packing apparatus is beneficially made from resin.

The side plates are beneficially foldably connected to the lower plate. The upper plate is beneficially foldably connected to the first side wall. The upper plate is beneficially foldably connected to the second side wall.

It is to be understood that both the foregoing general description and the following detailed description are exemplary and explanatory and are intended to provide further explanation of the invention as claimed.

BRIEF DESCRIPTION OF THE DRAWING

The accompanying drawings, which are included to provide a further understanding of the invention and are incorporated in and constitute a part of this specification, illustrate features of the invention and together with the description serve to explain the principles of the invention.

In the drawings.

DETAILED DESCRIPTION OF THE ILLUSTRATED EMBODIMENT

Reference will now be made in detail to an illustrated embodiment of the present invention, an example of which is illustrated in the accompanying drawings.

Figure 1:
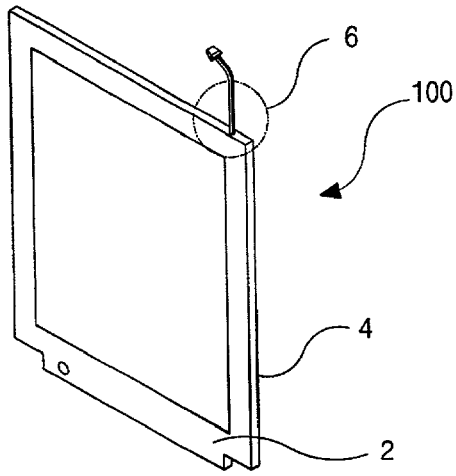
(related art) FIG. 1
FIG. 1 is a perspective view showing a LCM.
Figure 2:
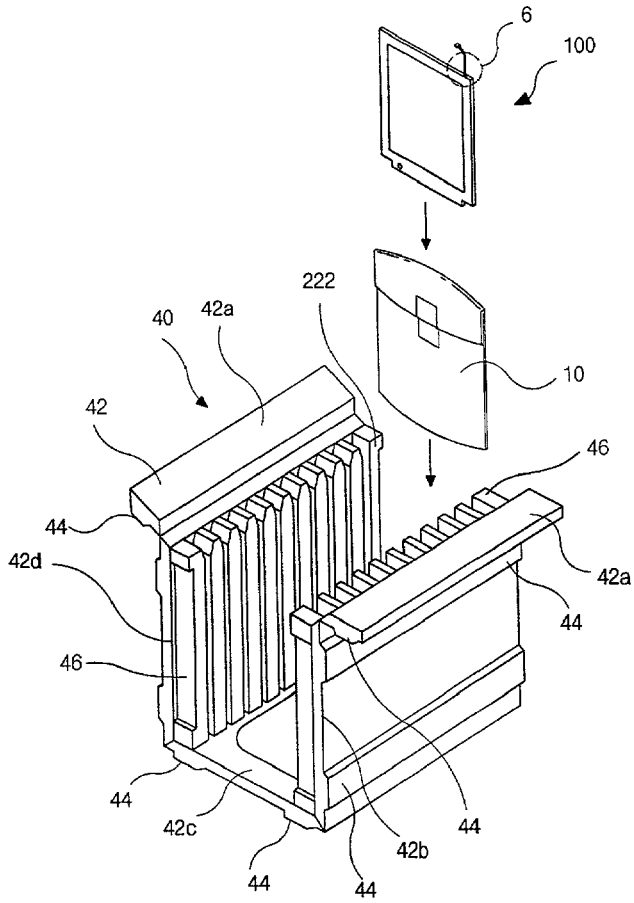
(related art) FIG. 2
FIG. 2 is a perspective view showing a prior art packing apparatus for LCMs.
Figure 3:
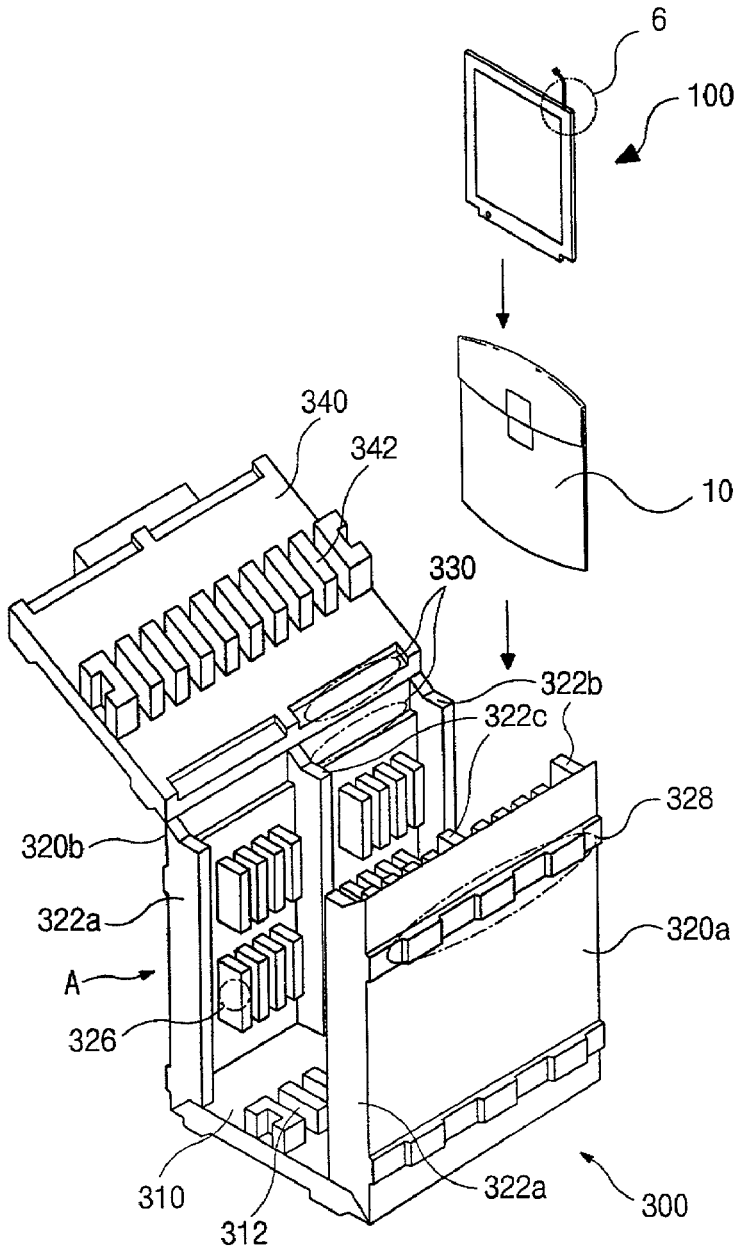
FIG. 3 is perspective view showing a packing apparatus for LCMs that is in accord with the principles of the present invention.

FIG. 3 is a perspective view of a packing apparatus 300 according to the principles of the present invention. In practice, a LCM 100 is placed into a shielding bag 10 before being inserted into the packing apparatus 300. The shielding bag protects the LCM 100 from static electricity and exterior impact. The shielding bag 10 is preferably made of polypropylene (PP), polyethylene (PE) or the like, and includes metallic material to reduce the impact of static electricity.

The packing apparatus 300 includes a lower plate 310, first and second side walls 320*a* and 320*b*, and an upper plate 340. The lower plate 310 preferably includes a plurality of centrally located first fixing jaws 312. The first and second side walls 320*a* and 320*b* extend from, but are connected to, the sides of the lower plate 310. The upper plate 340 extends from, but is connected to, the second side wall 320*b*. The upper plate 340 can be folded onto the first side wall 320*a* to retain LCMs 100 that have been inserted into the packing apparatus 300. A plurality of projections 328 are beneficially provided on the outer surfaces of the packing apparatus 300. Those projections absorb exterior impacts.

The first and second side walls 320*a* and 320*b* include first and second auxiliary side walls 322*a* and 322*b* at their ends, and preferably a third auxiliary side wall 322*c* at their middle. The first, second, and third auxiliary side walls 322*a*, 322*b*, and 322*c* extend perpendicularly from their corresponding side walls 320*a* and 320*b*. The auxiliary side walls 322*a*, 322*b*, and 322*c* reduce deformation of the side walls 320*a* and 320*b* when a normal impact is applied.

The first fixing jaws 312 of the lower plate 310 receive and retain LCMs 100. Second fixing jaws 326 that are similar to the first fixing jaws 312 are disposed on the inner surface of the first and second side walls 320*a* and 320*b*. Again, those jaws receive and retain LCMs 100 In addition, third fixing jaws 342 are disposed on the inner surface of the upper plate 340. Once again, those jaws receive and retain LCMs 100 Therefore, when an LCM 100 is placed into the packing apparatus 300 and the upper plate 340 is folded into position, the LCM 100 is held by corresponding first, second, and third fixing jaws 312, 326, and 342. The lower plate 310, first and second side walls 320*a* and 320*b*, and the upper plate 340 protect the held LCM 100.

The packing apparatus 300 is beneficially fabricated from a resin, such as expanded polyethylene (EPE) or expanded polypropylene (EPP), using a metal mold.

The packing apparatus 300 preferably has slant surfaces so that it can be easily folded. In other words, each edge or interconnected joint has a longitudinal section in the shape of a "V" such that the first and second side walls 320*a* and 320*b* are foldably connected to the lower plate 310, and the upper plate 340 is foldably connected to the second side wall 320*b*. Thus, the apparatus can easily be transformed to the flat, unfolded state of FIG. 4 from the folded state shown in FIG. 3. Further, the upper plate 340 has a width that is less than or equal to the width of the folded packing apparatus 300.

In addition, grooves 330 having a slit shape are formed at each side edge of the upper plate 340 and at the upper edges of the first and second side walls 320*a* and 320*b*. As illustrated in FIG. 3, the grooves 330 are substantially parallel to the upper edges of the first and second side walls 320*a* and 320*b*. The grooves 330 are designed to receive lamp wires 6 when LCMs 100 are placed into the packing apparatus 300. Thus, the grooves 330 prevent forceful contact between the upper plate 340 and the lamp wires 6.

The projections 328, which are preferably formed by protruding members on outer surfaces of the packing apparatus 300, serve to relieve and absorb exterior impacts on the packing apparatus 300. Each projection 328 preferably has an alternating stepped shape, forming a sequence of concave and convex structures.

The first, second, and third fixing jaws 312, 326, and 342 are spaced apart from each other by a predetermined distance and are aligned with fixing jaws on the other inner surfaces. The number of LCMs 100 able to be accommodated in the packing apparatus 300 and the corresponding number of fixing jaws 312, 326, and 342 can be varied as needed.

Figure 4:
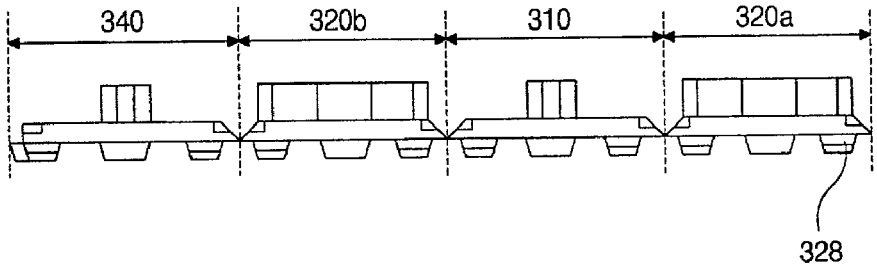
FIG. 4 is a diagram showing a side view of the packing apparatus of FIG. 3 when it is unfolded.

As shown in FIG. 4, the upper plate 340, the second side wall 320*b*, the lower substrate 310, and the first side wall 320*a* are sequentially connected together. Further, each connected edge portion has a "V" shape, which enables efficient folding of the packing apparatus 300 into the shape shown in FIG. 3.

It will be apparent to those skilled in the art that various modifications and variation can be made to the illustrated embodiment without departing from the spirit or scope of the invention. Thus, it is intended that the present invention covers the modifications and variations of this invention provided they come within the scope of the appended claims and their equivalents.

What is claimed is:

1. A liquid crystal display module packing apparatus for retaining liquid crystal display modules, wherein each of the liquid crystal display modules has a lamp wire, comprising:

a lower plate;

a first side wall extending from a first side of said lower plate, the first side wall including first to third auxiliary side walls extending from two ends and a center of the first side wall, respectively, wherein a plurality of first fixing jaws on an inner surface of the first side wall between the first and third auxiliary side walls and between the third and second auxiliary side walls;

a second side wall extending from a second side of said lower plate, the second sidewall including fourth to sixth auxiliary side walls extending from two ends and a center of the second side wall, respectively, wherein a plurality of second fixing jaws on an inner surface of the second side wall between the fourth and sixth auxiliary side walls and between the sixth and fifth auxiliary side walls;

an upper plate extending from an upper side of said first side wall and having a slit-shaped groove adjacent to an edge of either said first side wall or said second side wall for retaining the lamp wire, the slit-shaped groove substantially parallel to the edge of said first and second side walls; and a plurality of third and fourth fixing jaws disposed on surfaces of said lower plate and said upper plate, respectively, said first to fourth fixing jaws disposed to receive and retain the liquid crystal display modules.

2. A liquid crystal display module packing apparatus according to claim 1, further including a plurality of projections on surfaces to relieve exterior impacts.

3. A liquid crystal display module packing apparatus according to claim 2, wherein each projection has an alternating stepped shape.

4. A liquid crystal display module packing apparatus according to claim 1, further comprising a plurality of slit-shaped grooves in said first side wall.

5. A liquid crystal display module packing apparatus according to claim 1, wherein the packing apparatus is made from resin.

6. A liquid crystal display module packing apparatus according to claim 1, wherein said first side wall and said second side wall are foldably connected to said lower plate.

7. A liquid crystal display module packing apparatus according to claim 1, wherein said upper plate is foldably connected to said first side wall.

* * * * *